United States Patent [19]

Yamaguchi et al.

[11] 4,417,970

[45] Nov. 29, 1983

[54] ELECTROLYTIC CELL FOR ION EXCHANGE MEMBRANE METHOD

[75] Inventors: Kenzo Yamaguchi, Tokyo; Teruo Ichisaka; Tadao Ikegami, both of Tamano; Isao Kumagai, Tokyo, all of Japan

[73] Assignee: Chlorine Engineers Corp. Ltd., Tokyo, Japan

[21] Appl. No.: 437,598

[22] Filed: Oct. 29, 1982

[30] Foreign Application Priority Data

Nov. 24, 1981 [JP] Japan ..... 56-186928

[51] Int. Cl.[3] ..... C25B 9/00; C25B 11/03; C25B 13/02; C25B 15/08

[52] U.S. Cl. ..... 204/257; 204/263; 204/283; 204/296

[58] Field of Search ..... 204/252–258, 204/263–266, 283, 296, 279

[56] References Cited

U.S. PATENT DOCUMENTS 4,219,394 8/1980 Babinsky et al. ..... 204/296 X 4,229,277 10/1980 Specht ..... 204/296 X 4,263,121 4/1981 Christensen ..... 204/296

4,283,264 8/1981 Darling et al. ..... 204/296 X

*Primary Examiner*—Donald R. Valentine

*Attorney, Agent, or Firm*—Sughrue, Mion, Zinn, Macpeak and Seas

[57] ABSTRACT

An electrolytic cell having a plurality of porous and tubular cathodes, a plurality of porous anodes and a plurality of bag-shaped molds being formed by a cation exchange membrane in at least the portions facing and between the vertical faces of the anode and cathodes. The anode accomodating bag-shaped molds have apertures at the bottom through which anode connected electroconductive bars extend, said bars being inserted through and secured at corresponding cell bottom plate apertures by flanges. A partition plate, on the top of the cell main body, has a plurality of openings which correspond to the open tops of the bag-shaped molds. The open top edges of the bag-shaped molds are secured to the partition plate openings by a plurality of lid members.

5 Claims, 7 Drawing Figures

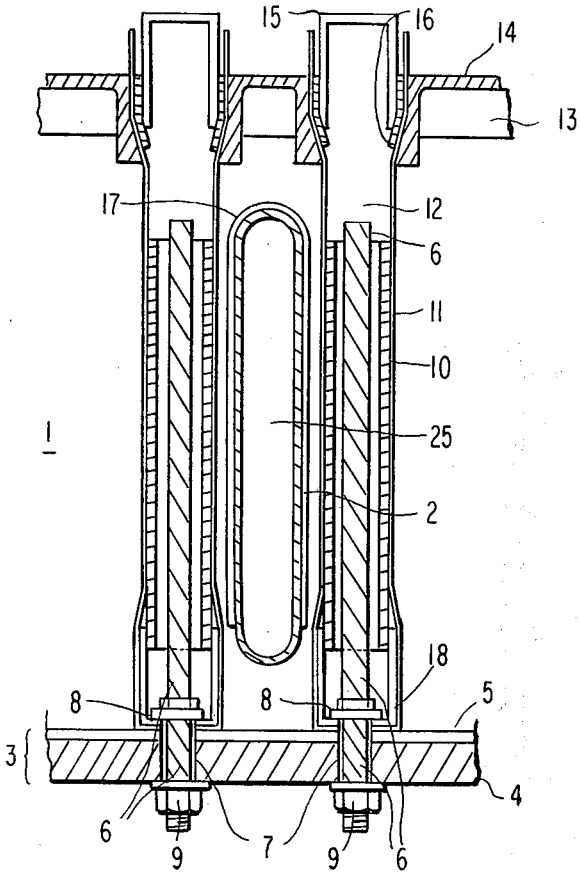
FIG. 1
FIG. 2
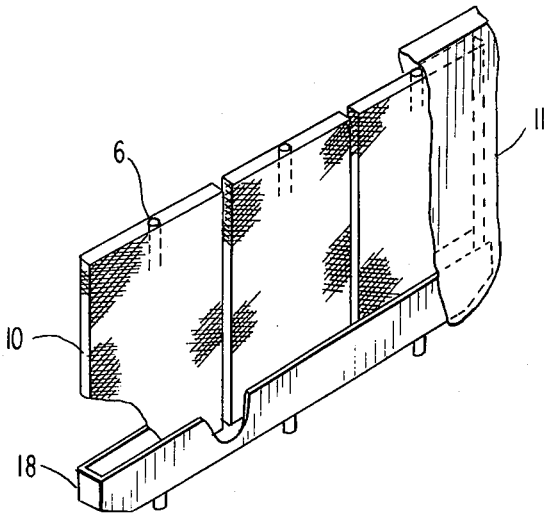
FIG. 3
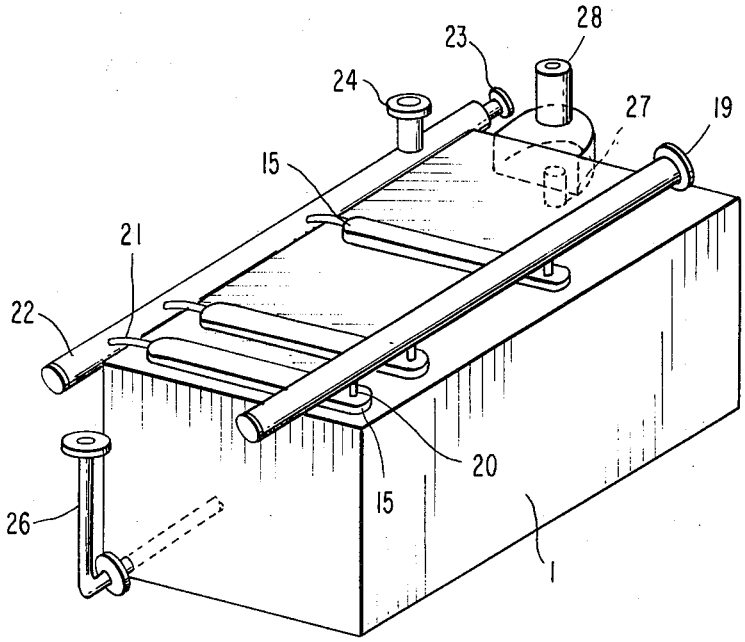

ELECTROLYTIC CELL FOR ION EXCHANGE MEMBRANE METHOD

FIELD OF THE INVENTION

The present invention relates to an electrolytic cell for use in the practice of an ion exchange membrane electrolysis method, and more particularly, to an electrolytic cell suitable for the production of halogen and alkali metal hydroxide by electrolyzing an aqueous solution of alkali metal halides.

BACKGROUND OF THE INVENTION

Heretofore, in the electrolysis of brine, a diaphragm method utilizing an electrolytic cell comprising an anode compartment and a cathode compartment separated from each other by a porous neutral diaphragm made of asbestos or the like has been used in place of the mercury method. This diaphragm method, however, has the disadvantage that high purity alkali metal hydroxide cannot be obtained. Thus, an ion exchange membrane method using a cation exchange membrane has been developed for the production of high purity alkali metal hydroxides.

SUMMARY OF THE INVENTION

An object of the invention is to provide an electrolytic cell suitable for use in the ion exchange membrane method, which can be produced by remodeling an electrolytic cell which has heretofore been used in the diaphragm method.

Another object of the invention is to provide an electrolytic cell which can be assembled by utilizing equipment used in the electrolytic cell for the diaphragm method, and which is free from the danger of liquid leakage and permits production of high concentration alkali metal hydroxide and maintenance of cell voltage at a low level.

The present invention, therefore, relates to an electrolytic cell for the ion exchange membrane method, comprising:

(a) an electrolytic cell main body;

(b) a plurality of porous and tubular cathodes disposed in the interior of the electrolytic cell main body;

(c) an electrolytic cell bottom plate having therein a plurality of apertures;

(d) a plurality of electrically conductive bars provided with a flange at a lower portion thereof, which are each inserted through the aperture of the electrolytic cell bottom plate into the interior of the electrolytic cell main body and secured to the electrolytic cell bottom plate by the flange;

(e) a plurality of porous anodes which are each connected to the electrically conductive bar and placed vertically in a face-to-face relation to the cathode, and which are disposed alone or in combination with each other between the cathodes;

(f) a plurality of bag-shaped molds, at least the portion facing the anodes and the cathodes being formed by a cation exchange membrane, which are each provided at the bottom thereof with an aperture through which the electrically conductive bar can be passed, and are open at the top;

(g) a partition plate which is provided on the top of the electrolytic cell main body, and which has a plurality of openings at the positions corresponding to the top openings of the bag-shaped molds; and (h) a plurality of lid members each of which covers the opening of the bag-shaped mold, wherein the bag-shaped mold accommodates one or more anodes;

the bottom of the bag-shaped mold is secured to the electrolytic cell bottom plate together with the electrically conductive bar extending through the aperture of the bottom of the bag-shaped mold by the flange so that an anode compartment is defined inside the bag-shaped mold; and the top opening edge of the bag-shaped mold is secured at the opening of the partition plate by the lid member.

BRIEF DESCRIPTION OF THE DRAWINGS

FIG. 1 is a fragmental, longitudinal-sectional view of an embodiment of the electrolytic cell according to the invention.

FIG. 2 is a partially cutaway perspective view of an anode portion.

FIG. 3 is a perspective view of the electrolytic cell.

DETAILED DESCRIPTION OF THE INVENTION

Figure 4:
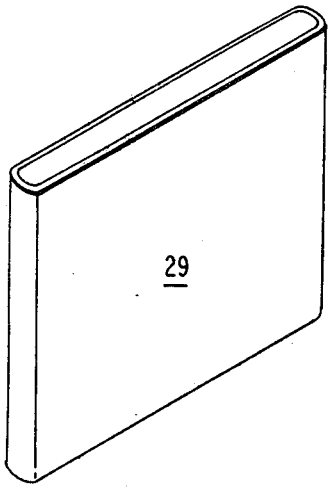
FIGS. 4 to 6 are each a perspective view of a bag-shaped mold as used in the invention.

The invention will hereinafter be explained with reference to the accompanying drawings wherein:

FIG. 1 is a fragmentally longitudinal-sectional side view of an embodiment of the electrolytic cell for the ion exchange membrane method according to the invention;

FIG. 2 is a partially cutaway perspective view of an anode portion; and

FIG. 3 is a perspective view of the electrolytic cell.

In an electrolytic cell main body 1, a plurality of porous and hollow tubular cathodes 2 are disposed so that they extend from one inner side wall of the electrolytic cell main body 1 to the opposite inner side wall thereof. An electrolytic cell bottom plate 3 comprises an electricity-supply plate 4 and an anticorrosion sheet 5 provided on the plate 4, and has a plurality of apertures 7. Each of the apertures is positioned at a location just intermediate between two adjacent cathodes 2, and through which an electrically conductive bar 6 can be extended. The electrically conductive bar 6 extends through an aperture 7 of the electrolytic cell bottom plate 3 into the interior of the electrolytic cell main body 1 and has a flange 8 at a lower portion thereof. This electrically conductive bar is secured to the electrolytic cell bottom plate 3 with the flange 8 by fastening nut 9. A porous anode 10 is connected to the electrically conductive bar 6 at an upper portion thereof, vertically supported in a face-to-face relation to the cathode 2, and is disposed at a location intermediate two adjacent cathodes 3.

A mold 11 is formed by a cation exchange membrane at least at portions facing the anode and cathode and is designed in a bag-like form so that it can accommodate one or more anodes 10, and the top of the bag-shaped mold 11 is open. The bag-shaped mold 11 is provided at a location corresponding to the aperture 7 of the electrolytic cell bottom plate 3 with an aperture through which the electrically conductive bar 6 can be extended. The bag-shaped mold 11 accommodates therein one or more anodes 10 in a close contact relationship with the portion defined by the cation exchange membrane of the bag-shaped mold 11, and it is secured to the electrolytic cell bottom plate 3 together with the electrically conductive bar 6 extending through the aperture of the bottom of the bag-shaped mold 11 by the flange 8. In this way, an anode compartment 12 is defined in the bag-shaped mold 11.

On the top of the electrolytic cell main body 1 is provided a partition plate 13 having an opening at a location corresponding to the upper opening of the bag-shaped mold 11, and a sheet 14 made of elastic material such as rubber is interposed between the partition 13 and the upper opening of the bag-shaped mold. An anode compartment upper lid member 15 is provided at an upper portion of each anode compartment 12, covering the upper opening of the bag-shaped mold 11, and the upper opening of the bag-shaped mold 11 is secured to the lid member at each opening of the partition plate 13. A sheet 16 made of elastic material such as rubber, is interposed between the anode compartment upper lid member 15 and the upper opening end of the bag-shaped mold 11. This sheet 16 serves to protect the bag-shaped mold 11 and also acts as a packing material.

The bag-shaped mold 11 and the anode 10 are preferably brought in contact with each other as closely as possible, and it is preferred to employ an anode of the structure that permits extension of the anode in the cathode direction. An example of anodes which can be extended in the cathode direction is described in, for example, Japanese Patent Publication No. 35031/75 (corresponding to U.S. Pat. No. 3,674,676). If necessary, a spacer 17 is interposed between the bag-shaped mold 11 and the cathode 2. It is preferred for the width of the space defined between the bag-shaped mold 11 and the cathode 2 by the interposition of the spacer to be maintained within the range of about 1 to 3 mm.

In order to protect the bag-shaped mold 11 from being broken at a lower portion of the anode by the pressure exerted from the cathode side to the anode side during electrolysis, it is desirable to provide a protective frame 18 to enclose the anode lower portion. The protective frame 18 is made of a corrosion-resistant material such as a fluorine resin, and its shape is not critical as long as it encloses the anode lower portion and holds the form of the bag-shaped mold.

Referring to FIG. 3, a manifold 19 for supplying an anolyte is shown. The manifold 19 has a plurality of small-diameter pipes 20 for supplying an anolyte, these small-diameter pipes extending to each anode compartment upper lid member 15, and the anolyte is introduced through each small-diameter pipe 20 into each anode compartment. In order to control the flow rate of the anolyte, the small-diameter pipe 20 is designed in a spiral form, or is provided with an orifice meter. The anode compartment upper lid member 15 is provided with a discharge small-diameter pipe 21 at a side portion thereof so that the liquid and gas from the anode compartment can overflow through the discharge small-diameter pipe 21. Also there is provided a manifold 22 to which a plurality of discharge small-diameter pipes 21 are connected. The liquid and gas discharged from the anode compartment are introduced into the manifold 22 where they are separated from each other, and the liquid is withdrawn from an outlet 23 and the gas from an outlet 24.

A cathode compartment 25 is defined outside of the bag-shaped mold 11 in the electrolytic cell main body 1, and dilute alkali or water is introduced through a catholyte-supplying pipe 26 into the cathode compartment. The liquid and gas from the cathode compartment, overflowing from the top of the electrolytic cell main body 1, are withdrawn through outlets 27 and 28, respectively.

Figure 5:
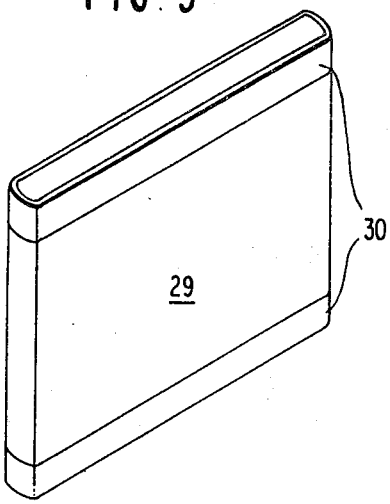
Figure 6:
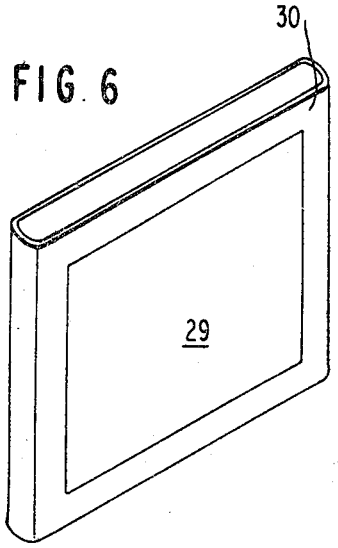

The bag-shaped mold 11 as used herein is designed so that at least the portions facing the anode and cathode are made of a cation exchange membrane. Various embodiments are included in the invention, including an embodiment as shown in FIG. 4 wherein the entire mold is made of a cation exchange membrane 29; an embodiment as shown in FIG. 5 wherein the bottom of a mold which is secured to the electrolytic cell bottom plate, and the upper portion of the mold which is held in position between the partition plate 13 and the anode upper lid member 15 are formed of a corrosion-resistant material 30, e.g., a fluorine resin, and the central portions facing the anode and cathode are made of a cation exchange membrane 29; and an embodiment as shown in FIG. 6 wherein only the portions facing the anode and cathode are formed of a cation exchange membrane 29, and the frame is made of a corrosion-resistant material. The invention is not limited to the above-described embodiments, and it is sufficient for the bag-shaped mold to be made of a cation exchange membrane at least at the portions facing the cathode and anode. The other portions may be made of a corrosion-resistant material and can be designed in various forms depending on the structure of each electrode. When a cation exchange membrane and a corrosion-resistant material are used to form a bag-shaped mold, they are bonded together by, for example, heat-sealing. When the entire mold is formed of a cation exchange membrane, portions coming into contact with the lower end portion of the anode are readily damaged and, therefore, the above-described protective frame 18 for protecting the mold becomes important.

Figure 7:
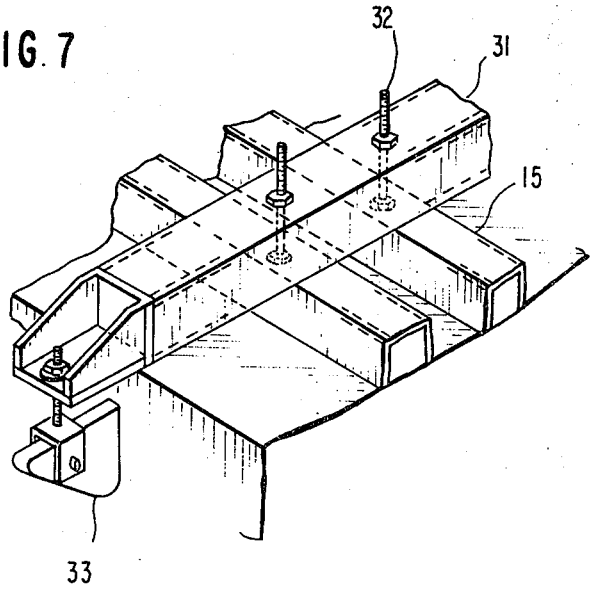
FIG. 7 is a partially enlarged view of the top of the electrolytic cell, illustrating a method of securing the lid member to the top of the anode compartments.

FIG. 7 is a partially enlarged view of the top portion of an electrolytic cell illustrating a method of securing the anode compartment lid member 15. Referring to FIG. 7, each anode compartment upper lid member 15 is secured to a lid member-fixing member 31 by a clamp bolt 32, and both ends of the lid member-fixing member 31 are secured to projections 33 provided at each side of the electrolytic cell main body 1 by fastening with a bolt.

The electrolytic cell of the invention has a structure that is suitable for remodeling an electrolytic cell heretofore used in the diaphragm method into an electrolytic cell for the ion exchange membrane method. In the usual electrolytic cell for use in the diaphragm method in which a neutral diaphragm comprising asbestos is used, a porous and hollow tubular cathode is covered by the asbestos diaphragm to thereby form a cathode compartment, and an anode supported on an electrically conductive bar is disposed between the cathodes covered with the diaphragm. In accordance with the invention, by utilizing parts of the electrolytic cell for the diaphragm method, such as the electrolytic cell main body, the lid member, cathodes, and anodes, an electrolytic cell having an excellent structure for use in the ion exchange membrane method can be produced.

In the electrolytic cell of the invention, an anode is surrounded by a bag-shaped mold in which at least portions facing the anode and cathode are made of a cation exchange membrane; the bottom of the bag-shaped mold is secured to an electrolytic cell bottom plate by a flange of an electrically conductive bar; and the upper open end of the mold is secured to an anode compartment upper lid member at an opening of a partition plate provided at an upper portion of the electrolytic cell main body. Thus, the cation exchange membrane can be held in position in a closed condition with no relaxation, and as the anode can be brought into close contact with the cation exchange membrane by utilizing an anode having the structure that allows the anode-acting surface to extend in the cathode direction, the invention is advantageous as an excellent structure for the ion exchange membrane method.

By forming the upper and lower portions of the bag-shaped mold using a corrosion-resistant material, the cation exchange membrane can be prevented from being damaged by sharp parts of the anode end portion and, furthermore, the bag-shaped mold can be protected by surrounding the lower end portion of the anode with a protective frame.

In the structure of the present electrolytic cell, there is no danger of explosion due to the mixing of anode side gas and cathode side gas even if a gas leakage occurs between the partition plate of the electrolytic cell main body upper portion and the open end of the bag-shaped mold, or between the anode compartment upper lid member and the open end of the bag-shaped mold, because the outside is open to the air.

While the invention has been particularly shown and described with reference to preferred embodiments thereof, it will be understood by those skilled in the art that various changes in form and details may be made therein without departing from the spirit and scope of the invention.

What is claimed is:

1. An electrolytic cell for the ion exchange membrane method which comprises:

(a) an electrolytic cell main body;

(b) a plurality of porous and tubular cathodes disposed in the interior of the electrolytic cell main body;

(c) an electrolytic cell bottom plate having therein a plurality of apertures;

(d) a plurality of electrically conductive bars provided with a flange at a lower portion thereof, which are each inserted through the aperture of the electrolytic cell bottom plate into the interior of the electrolytic cell main body and secured to the electrolytic cell bottom plate by the flange;

(e) a plurality of porous anodes which are each connected to the electrically conductive bar and placed vertically in a face-to-face relationship to the cathode, and which are disposed alone or in combination with each other between the cathodes;

(f) a plurality of bag-shaped molds, at least the portions facing the anodes and the cathodes being formed by a cation exchange membrane, which are each provided at the bottom thereof with an aperture through which the electrically conductive bar can be passed, and are open at the top;

(g) a partition plate which is provided on the top of the electrolytic cell main body, and which has a plurality of openings at the positions corresponding to the top openings of the bag-shaped molds; and (h) a plurality of lid members each of which covers an opening of the bag-shaped mold, wherein the bag-shaped mold accommodates one or more anodes;

the bottom of the bag-shaped mold is secured to the electrolytic cell bottom plate together with the electrically conductive bar extending through the aperture of the bottom of the bag-shaped mold by the flange so that an anode compartment is defined inside the bag-shaped mold; and the top opening edge of the bag-shaped mold is secured at the opening of the partition plate by the lid member.

2. The electrolytic cell as claimed in claim 1, further including a manifold for supplying an anolyte and a small-diameter pipe for supplying an anolyte, extending from the manifold to each anode compartment upper lid member.

3. The electrolytic cell as claimed in claim 1, further including a discharge small-diameter pipe through which liquid and gas from the anode compartment overflow into the side portion of the anode compartment upper lid member and a manifold to which each discharge small-diameter pipe is connected.

4. The electrolytic cell as claimed in claim 1, further including a lid member-fixing member to which each anode compartment upper lid member is secured, and which is in turn secured to the electrolytic cell main body.

5. The electrolytic cell as claimed in claim 1, further including a protective frame for protecting the bag-shaped mold, which is positioned in the interior of the bag-shaped mold and encloses the lower end portion of the anode.

* * * * *